US010378495B2

(12) United States Patent
John et al.

(10) Patent No.: US 10,378,495 B2
(45) Date of Patent: Aug. 13, 2019

(54) FUEL SYSTEM HAVING PURGING CAPABILITY FOR REDUCED FUEL DRIBBLE

(71) Applicant: Caterpillar Inc., Peoria, IL (US)

(72) Inventors: Bobby John, Peoria, IL (US); Glen Martin, Peoria, IL (US); Jonathan W. Anders, Peoria, IL (US); Robert Campion, Chillicothe, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/796,916

(22) Filed: Oct. 30, 2017

(65) Prior Publication Data

US 2019/0128228 A1 May 2, 2019

(51) Int. Cl.

*F02M 47/06* (2006.01)
*F02M 55/00* (2006.01)
*F02M 61/18* (2006.01)

(52) U.S. Cl.

CPC ..... *F02M 47/06* (2013.01); *F02M 55/002* (2013.01); *F02M 61/1886* (2013.01)

(58) Field of Classification Search

CPC .... F02M 47/027; F02M 47/06; F02M 55/002; F02M 61/1886; Y02T 10/36; F02D 19/081; F02D 19/0647; F02D 19/0655; F02D 19/0694; F02D 19/0613

USPC ..... 123/467, 575, 576, 577, 578

See application file for complete search history.

(56) References Cited

U.S. PATENT DOCUMENTS

| | | | | |
|---|---|---|---|---|
| 4,782,794 | A * | 11/1988 | Hsu | F02D 19/04 123/23 |
| 6,601,566 | B2 | 8/2003 | Gillis et al. | |
| 6,616,070 | B1 | 9/2003 | Kunkulagunta | |
| 7,243,862 | B2 | 7/2007 | Dingle | |
| 7,685,990 | B2 | 3/2010 | Dingle | |
| 8,490,888 | B2 | 7/2013 | Greeves et al. | |
| 8,496,191 | B2 | 7/2013 | Grant et al. | |
| 8,978,623 | B2 | 3/2015 | Sommars et al. | |
| 9,506,434 | B2 | 11/2016 | Coldren | |
| 2010/0199948 | A1* | 8/2010 | Rogak | F02D 19/0647 123/304 |
| 2013/0213358 | A1* | 8/2013 | Hou | F02D 19/0694 123/445 |
| 2014/0182552 | A1* | 7/2014 | Brown | F02D 19/10 123/456 |
| 2014/0188372 | A1* | 7/2014 | Puckett | F02M 21/0281 701/104 |
| 2014/0311451 | A1* | 10/2014 | Fang | F02M 21/0284 123/445 |

* cited by examiner

*Primary Examiner* — Sizo B Vilakazi
(74) *Attorney, Agent, or Firm* — Jonathan F. Yates

(57) ABSTRACT

A fuel system includes a fuel injector having a fuel passage and a purging fluid passage formed therein. A nozzle tip inner surface defines a sac forming a blind end of the fuel passage in the fuel injector. A coaxial concentric check assembly includes a purging check movable to admit a purging fluid such as pressurized air into the fuel passage to purge the sac of fuel. Reduced injector dribble is observed from the purging of fuel.

20 Claims, 4 Drawing Sheets

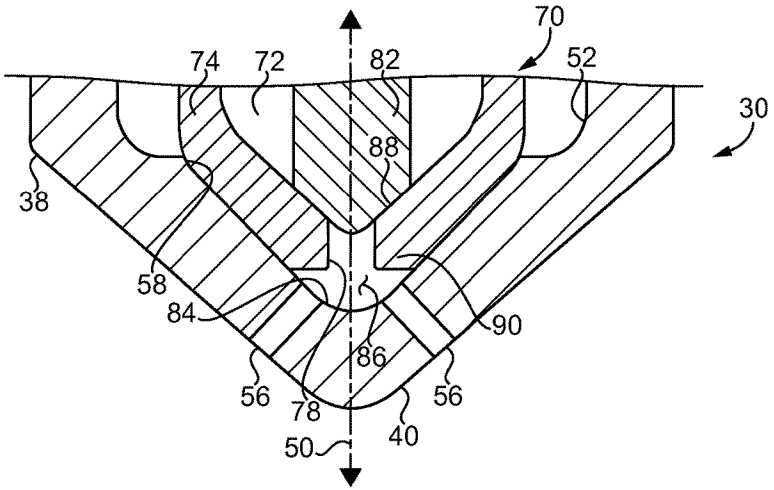
FIG. 3
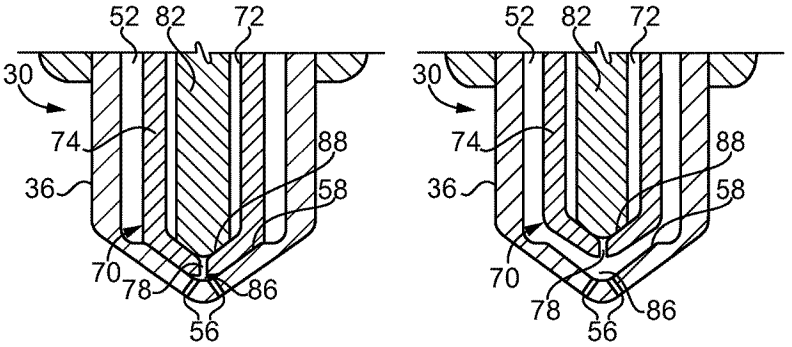
FIG. 4
FIG. 5
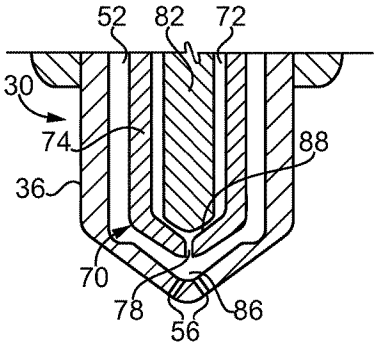
FIG. 6

FUEL SYSTEM HAVING PURGING CAPABILITY FOR REDUCED FUEL DRIBBLE

TECHNICAL FIELD

The present disclosure relates generally to a fuel system for an internal combustion engine, and more particularly to a fuel injector having a check assembly with a purging check movable to control admission of a purging fluid to a fuel passage for purging the fuel passage of fuel.

BACKGROUND

A variety of different technologies are used in modern internal combustion engines to optimize efficiency and manage emissions. In many engines it is desirable to limit production or output of particulate matter, oxides of nitrogen or "NOx," and other materials such as unburned hydrocarbons, and carbon monoxide. Engine operating strategies for limiting certain emissions, including variable valve actuation strategies, post injections, pre-injections, exhaust gas recirculation or "EGR," exhaust back pressure control strategies, and a host of others have been proposed over the years, with varying degrees of success. It is also well-known to treat exhaust directly, by way of catalyst-based reduction of certain exhaust constituents, particulate traps, and still others. Despite many advances across a range of technologies, engineers continue to search for improved ways to operate engines and ancillary engine systems, and new or further refined component designs, with the goal of optimizing engine emissions without sacrificing performance, efficiency or other desirable factors.

In recent years, significant engineering effort has gone into the development of improved fuel injector designs and operating techniques, notably for compression ignition diesel engines. It has been observed that relatively high fuel pressure can promote fuel atomization, which in turn tends to be associated with more complete burning of injected fuel and reduced production of particulate matter. Other techniques seek to strictly control start of injection and end of injection so as to provide a desirable, typically square, injection rate shape that provides desirable combustion characteristics.

One particular fuel injector design is known from U.S. Pat. No. 6,601,566 to Gillis et al., including directly controlled dual concentric checks in a fuel injector for a dual fuel engine. In the dual fuel environment of Gillis et al. two separate fuel injection checks can be packaged in a relatively modest space, and enabling use of two distinct quantities of liquid fuel to various ends, including operating the engine relatively more efficiently and more completely burning the fuel to produce lowered emissions.

SUMMARY OF THE INVENTION

In one aspect, a fuel injector includes an injector body defining a longitudinal axis and having a nozzle, the injector body having formed therein a fuel passage extending between a fuel inlet and a set of nozzle outlets. The nozzle includes an outlet check seat, and the set of nozzle outlets being distributed circumferentially about the longitudinal axis at locations that are adjacent to the outlet check seat and radially inward of the outlet check seat. The nozzle further includes a nozzle tip inner surface that is adjacent to the set of nozzle outlets and located radially inward of the set of nozzle outlets. The nozzle tip inner surface has a continuous extent amongst the set of nozzle outlets, such that the nozzle tip inner surface defines a sac forming a blind end of the fuel passage. The fuel injector further includes a check assembly positioned within the injector body, and having formed therein a purging fluid passage extending between a purging fluid inlet and a purging fluid outlet that opens to the fuel passage. The check assembly further includes an outlet check movable within the injector body between a retracted position where the fuel passage is in fluid communication with the set of nozzle outlets, and an advanced position where the outlet check contacts the outlet check seat. The check assembly further includes a purging check movable within the injector body between an advanced position where the purging check blocks the purging fluid outlet, and a retracted position where the purging fluid passage is in fluid communication with the fuel passage to admit purging fluid to the fuel passage for purging the sac of fuel.

In another aspect, a fuel system includes a fuel supply, a purging fluid supply, and a fuel injector having each of a fuel passage and a purging fluid passage formed therein. The fuel passage extends between a fuel inlet connected with the fuel supply and a set of nozzle outlets. The purging fluid passage extends between a purging fluid inlet connected with the purging fluid supply and a purging fluid outlet that opens to the fuel passage. The fuel injector further includes a nozzle tip inner surface that is adjacent to the set of nozzle outlets and has a continuous extent amongst the set of nozzle outlets, such that the nozzle tip inner surface defines a sac forming a blind end of the fuel passage. The fuel injector further includes an outlet check movable to control opening and closing of the plurality of nozzle outlets, and a purging check. The purging check is movable between an advanced position where the purging check blocks the purging fluid outlet, and a retracted position where the purging fluid passage is in fluid communication with the fuel passage to admit purging fluid to the fuel passage for purging the sac of fuel.

In still another aspect, a method of operating a fuel system for an internal combustion engine includes adjusting an outlet check in a fuel injector from a closed position to an open position, and spraying fuel out of a set of nozzle outlets in response to the adjusting of the outlet check in a fuel injector from a closed position to an open position. The method further includes adjusting a purging check in the fuel injector from a closed position to an open position, and purging the fuel passage of fuel by way of purging fluid admitted to the fuel passage in response to the adjusting of the purging check in the fuel injector from the closed position to the open position. The method still further includes reducing fuel dribble out of the fuel injector by way of the purging of the fuel passage of fuel.

BRIEF DESCRIPTION OF THE DRAWINGS

FIG. 3 is a sectioned view through a portion of the fuel injector of FIG. 3;

FIG. 4 is a sectioned view through a fuel injector, according to one embodiment, with a check assembly in a first configuration;

FIG. 5 is a view similar to FIG. 4 with the check assembly in another configuration;

FIG. 6 is a view similar to FIGS. 4 and 5 with the check assembly in yet another configuration;

DETAILED DESCRIPTION

Figure 1:
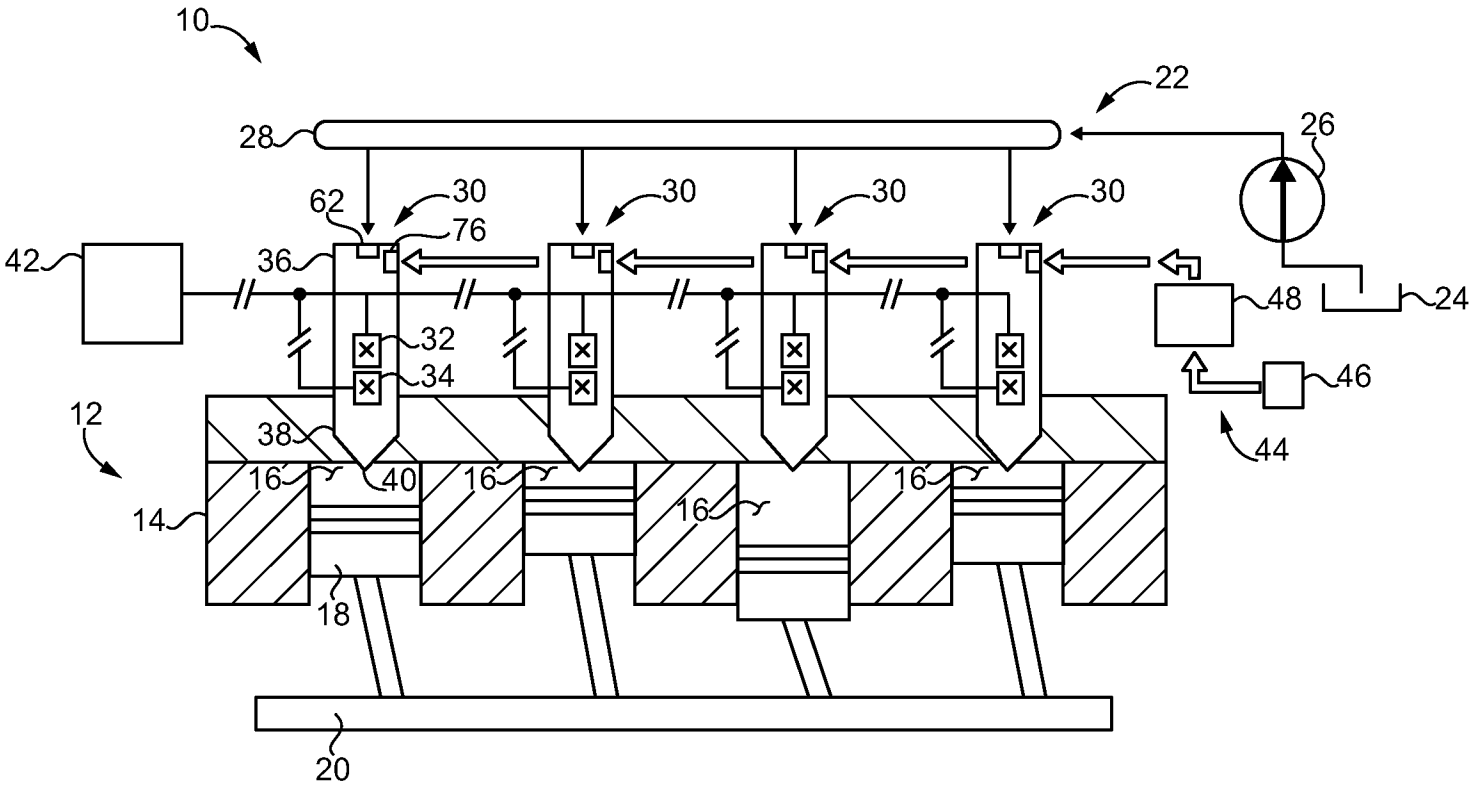
FIG. 1 is a partially sectioned side diagrammatic view of an engine system, according to one embodiment.

Referring to FIG. 1, there is shown an engine system 10 according to one embodiment, and including an internal combustion engine 12 such as a direct injected compression ignition diesel engine. In alternative embodiments, internal combustion engine 10 could be a spark-ignited engine, for instance. Internal combustion engine 12 (hereinafter "engine 12") includes an engine housing 14 having a plurality of cylinders 16 formed therein. A plurality of pistons 18 are positioned one within each of cylinders 16, and each movable between a bottom dead center position and a top dead center position in a four-stroke engine cycle, for example, to rotate a crankshaft 20 in a generally conventional manner. Engine system 10 further includes a fuel system 22 having a fuel supply or tank 24 and one or more fuel pumps 26 structured to supply and pressurize fuel, such as diesel distillate fuel, for delivery to a common rail 28 in a generally conventional manner. It should be appreciated that rather than a common rail configuration, a plurality of unit pumps, or still another fuel pumping and pressurization strategy, might be employed. Common rail 28 is coupled with a plurality of fuel injectors 30 mounted within engine housing 14 and each positioned to extend partially into a corresponding one of cylinders 16. Fuel injectors 30 may be identical or substantially identical to one another in a practical implementation and, accordingly, descriptions herein of an individual one of fuel injectors 30 will be understood to refer by way of analogy to the other fuel injectors 30 in engine 12. Each of fuel injectors 30 includes an injector body 36, and various components positioned within the corresponding injector body 36 to effectuate injection of fuel directly into the corresponding cylinder 16. A tip 40 of each fuel injector 30 can extend downwardly into the corresponding cylinder 16.

Each fuel injector 30 can further include an electrical actuator 32 structured to control initiation of a fuel injection event, and termination of the fuel injection event. Each fuel injector 30 can further include a second electrical actuator 34 structured to control the initiation of a purging fluid delivery event and termination of the purging fluid delivery event. It has been observed that a phenomenon known as fuel "dribble" or "dribbling" from tip 40 can result in fuel being delivered into an engine cylinder after the time at which fuel injection is desirably terminated, and/or being delivered in a manner that is undesirable, such as not atomized or not substantially atomized. The dribbled fuel is further understood to burn incompletely, not burn at all, or otherwise produce undesired emissions that can make achieving performance and operating goals of an engine challenging. As will be further apparent from the following description, engine system 10 is uniquely structured to controllably inject fuel in a manner that eliminates or substantially reduces the fuel dribble phenomenon.

An electronic control unit 42 may be in control communication with electrical actuators 32 and also with electrical actuators 34 for purposes consistent with the aims of controllably injecting fuel without fuel dribble. Engine system 10 also includes a purging fluid supply 44 having a purging fluid supply inlet 46 structured to feed purging fluid, such as air, to fuel injectors 30, in parallel with fuel fed from fuel tank 24 by way of common rail 28 or other fuel delivery means. A purging fluid filter 48 can be positioned fluidly between purging fluid supply inlet 46 and each of a plurality of purging fluid inlets 76 formed in each injector body 36 of the plurality of fuel injectors 30. Also formed in injector body 36 of each of the plurality of fuel injectors 30 is a fuel inlet 62.

Figure 2:
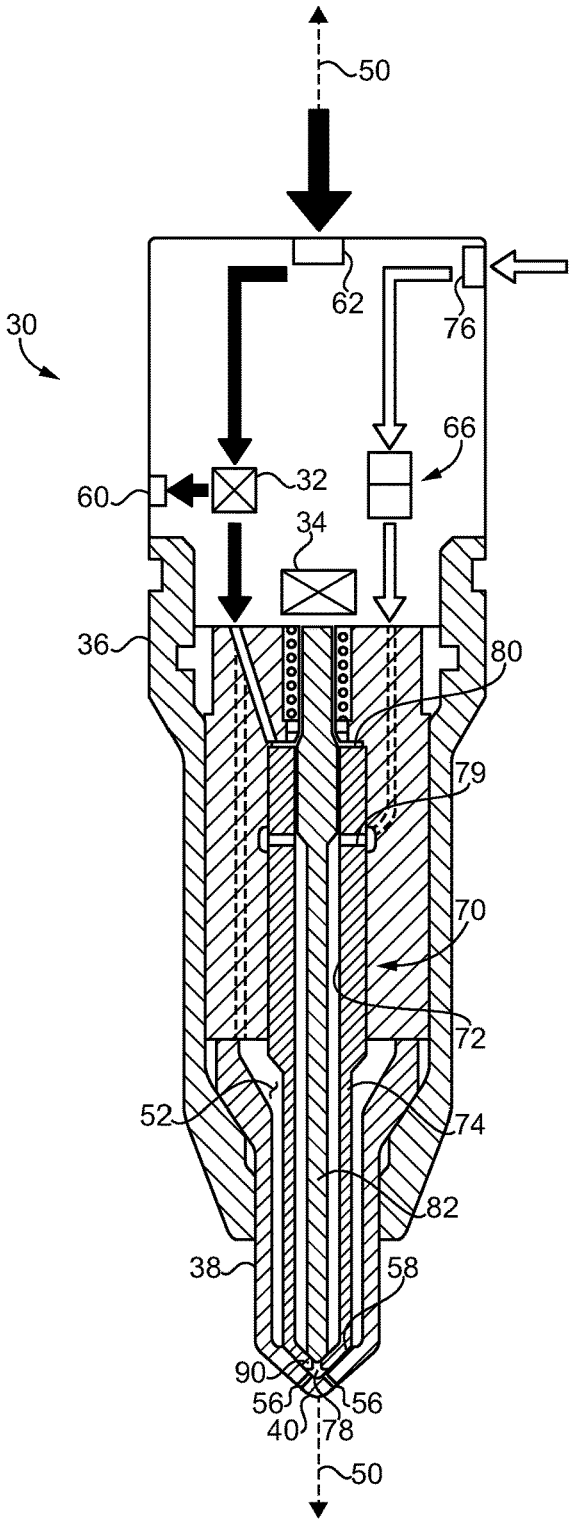
FIG. 2 is a partially sectioned side diagrammatic view of a fuel injector, according to one embodiment.

Turning now to FIG. 2, there are shown features of an example one of fuel injectors 30 in greater detail. Fuel injector 30 includes injector body 36, which defines a longitudinal axis 50 and includes a nozzle 38. Injector body 36 further has formed therein a fuel passage 52 extending between fuel inlet 62 and a set of nozzle outlets 56 formed in nozzle 38. Tip 40 is understood to be part of nozzle 38 and is within one of cylinders 16 when fuel injector 30 is positioned for service in engine 12. In a practical implementation, nozzle outlets 56 can be uniformly oriented and regularly spaced circumferentially about longitudinal axis 50. The present disclosure is not limited as such, and other nozzle arrangements might be employed. Fuel injector 30 also includes a low pressure outlet 60. Electrical actuator 32 may be coupled with a valve member (not shown), such as a nail valve, an assembly of a nail valve and a ball valve, various types of poppet valves or spool valves, or still another configuration of valves that enables internal plumbing in injector body 36 to be selectively connected to low pressure outlet 60, for purposes of controlling the timing of fuel injection as discussed herein.

Nozzle 38 further includes an outlet check seat 58, with nozzle outlets 56 being distributed circumferentially about longitudinal axis 50 at locations that are adjacent to outlet check seat 58 and radially inward of outlet check seat 58. A check assembly 70 is also positioned within injector body 36, check assembly 70 having formed therein a purging fluid passage 72 extending between a purging fluid inlet 79 formed in check assembly 70 and a purging fluid outlet 78 that opens to fuel passage 52. Purging fluid inlet 79 may fluidly connect to purging fluid inlet 76 in injector body 36. Check assembly 70 further includes an outlet check 74 movable within injector body 36 between a retracted position where fuel passage 52 is in fluid communication with the set of nozzle outlets 56, and an advanced position where outlet check 74 contacts outlet check seat 58. Check assembly 70 also includes a purging check 82 movable within injector body 36 between an advanced position where purging check 82 blocks purging fluid outlet 78, and a retracted position where purging fluid passage 72 is in fluid communication with fuel passage 52 to admit purging fluid to fuel passage 52.

In the illustrated embodiment, purging check 82 and outlet check 74 are concentric, and coaxially arranged with one another within injector body 36. Purging check 82 is shown positioned within outlet check 74, and outlet check 74 includes a distal tip 90 having purging fluid outlet 78 formed therein. It will be recalled that electrical actuator 32 can selectively connect internal plumbing of fuel injector 30 with low pressure outlet 60 to control injection of fuel. In a practical implementation, outlet check 74 can include a closing hydraulic surface 80 exposed to a fluid pressure of fuel inlet 62 or alternately a fluid pressure of low pressure outlet 60. Varying a fluid pressure acting upon closing hydraulic surface 80 in this general manner controls the opening and closing of nozzle outlets 56. As noted above, purging check 82 can be operated, such as by way of electrical actuator 34, to supply purging fluid such as pressurized air to the vicinity of nozzle outlets 56. In the illustrated embodiment, fuel injector 30 also includes a plunger 66 that can be used to pressurize purging fluid delivered by way of purging fluid inlet 76 for delivery to purging fluid passage 72. Plunger 66, or another fluid pressurization mechanism, could be cam actuated, hydraulically actuated, or actuated by another technique altogether. Moreover, rather than pressurizing the purging fluid within fuel injector 30, a compressor or other purging fluid pressurization device could be employed that feeds pressurized purging fluid to all of fuel injectors 30 in engine system 10. Electrical actuator 34 could be a solenoid actuator, as could electrical actuator 32, used in a generally conventional manner to lift purging check 82 to open purging fluid outlet 78. Alternatively or in addition, the pressure of purging fluid conveyed through purging fluid passage 72 could act on opening pneumatic or hydraulic surfaces of purging check 82 to achieve similar aims. It should be appreciated that no limitation as to any particular strategy for controlling the opening and closing of outlet check 74 and purging check 82 is intended by way of the present description, and a great many different possible configurations will be apparent to those skilled in the art.

Referring also now to FIG. 3, there are shown additional features of injector 30 and in particular nozzle 38 in greater detail. It will be recalled that nozzle outlets 56 are positioned at locations adjacent to outlet check seat 58 and radially inward of outlet check seat 58. Nozzle 38 further includes a nozzle tip inner surface 84 that is adjacent to nozzle outlets 56 and located radially inward of nozzle outlets 56. Nozzle tip inner surface 84 has a continuous extent amongst nozzle outlets 56, such that nozzle tip inner surface 84 defines a sac 86 forming a blind end of fuel passage 52. Admission of purging fluid to fuel passage 52, by way of purging fluid outlet 78 in the illustrated embodiment, enables purging fluid to purge sac 86 of fuel. As will be explained in further detail below, purging fluid can push fuel that would otherwise be left in sac 86 out of nozzle outlets 56, and/or back into fuel passage 52, eliminating a volume of fuel that might otherwise cause or contribute to the phenomenon of fuel dribble.

Outlet check 74 also includes purging check seat 88, which is contacted by purging check 82 at the advanced position. Purging check seat 88 extends circumferentially around purging fluid outlet 78, in the illustrated embodiment. It can still further be noted that purging fluid passage 72 is formed between outlet check 74 and purging check 82. In the embodiment shown in FIG. 3, nozzle outlets 56 are blocked from fluid communication with sac 86 at the advanced position of outlet check 74. Purging check seat 88 can further be seen to be located radially inward of outlet check seat 58, and purging check seat 88 and outlet check seat 58 are at different axial locations in nozzle 38. In other embodiments, the respective seats 58 and 88 could be at similar axial locations. It should also be appreciated that check assembly 70 could include checks that are side by side, where outlet check 74 is within purging check 82, or potentially checks where purging fluid outlet 78 did not open directly to sac 86. As also mentioned above, nozzle tip inner surface 84 is continuous in extent amongst nozzle outlets 56. Nozzle 38 includes a total of one set of nozzle outlets, and nozzle tip inner surface 84 is thus not perforated by any other nozzle outlets except those controlled by way of outlet check 74, in contrast to certain other fuel injector designs where multiple checks are used to control opening and closing of different sets of nozzle outlets. Still another way to understand the configuration is that the outlet(s) controlled by purging fluid check 82, purging fluid outlet 78, is internal to nozzle 38, whereas nozzle outlets 56 open externally of nozzle 38.

Figure 7:
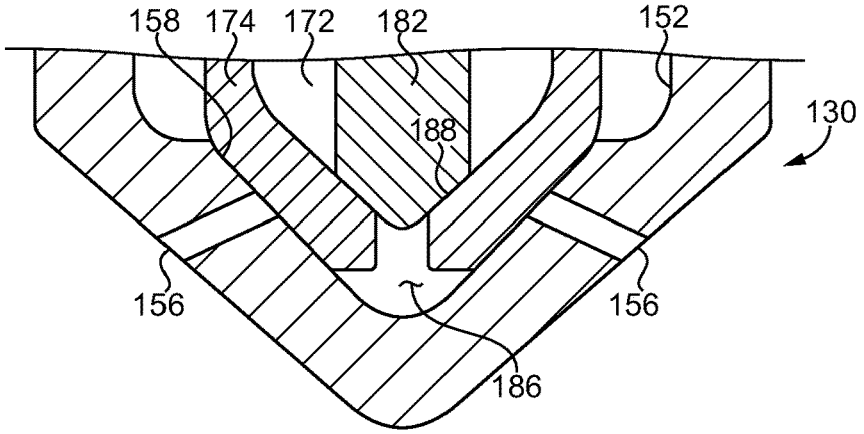
FIG. 7 is a sectioned view through a portion of a fuel injector, according to another embodiment.

Referring to FIG. 7, there is shown a portion of a fuel injector 130 according to another embodiment, having formed therein a fuel passage 152, and receiving a purging fluid check 182 positioned within an outlet check 174. Outlet check 174 is movable in a manner generally analogous to the previously described embodiment to fluidly connect fuel passage 152 with a plurality of nozzle outlets 156. Purging fluid check 182 is movable within fuel injector 130 and within outlet check 174 to connect a purging fluid passage 172 with a sac 186 and nozzle outlets 156. A purging check seat is shown at 188, and is positioned at a similar axial position relative to outlet check seat 158, although the axial positions of the respective seats could be varied from that shown. Either one of outlet check seat 158 or purging check seat 188 could be axially inward/outward of the other. It can also be noted that fuel injector 130 differs from previously described fuel injector 30 in that nozzle outlets 156 are not in fluid communication with sac 186 when outlet check 174 is at the advanced, closed position blocking outlet check seat 158.

INDUSTRIAL APPLICABILITY

Referring to the drawings generally, but in particular now to FIGS. 4-6, there is shown fuel injector 30 as it might appear in different configurations determined by positions of outlet check 74 and purging check 82 within injector body 36. During operating fuel system 22, outlet check 74 and purging check 82 may be positioned at the respective advanced, closed positions between fuel injection events. When it is desirable to initiate fuel injection, outlet check 74 can be adjusted from its advanced, closed position to its retracted, open position. In response to the adjusting of outlet check 74, fuel is sprayed out of nozzle outlets 56. It can be seen that outlet check 74 is adjusted in this general manner between the configuration shown in FIG. 4 and the configuration shown in FIG. 5. To terminate fuel injection, outlet check 74 is returned to its advanced, closed position. When it is desirable to initiate admission of purging fluid to fuel passage 52, and in particular to sac 86, purging check 82 can be moved from its advanced, closed position to its retracted, open position. In response to the adjusting of purging check 82 in this manner, pressurized purging fluid flows through purging fluid outlet 78 such that fuel passage 52 is purged of fuel. As noted above, purging of fuel passage 52 of fuel can include purging sac 86, by way of pushing fuel from sac 86 out of nozzle outlets 56, with sac 86 typically being purged, at least substantially, prior to purging nozzle outlets 56. Initiating the admission of purging fluid occurs by way of adjustments approximately as depicted in the change from the configuration of fuel injector 30 shown in FIG. 5 to the configuration shown at FIG. 6.

In an implementation, adjusting purging check 82 from its closed position to its open position can be commenced prior to completing returning of outlet check 74 from its open position to its closed position. Purging check 82 can be opened prior to, after, or at the same time as, closing of outlet check 74, however. At the appropriate timing, purging check 82 begins to lift from seat 88 to move toward its open position. It can be seen that at the state depicted in FIG. 6 purging fluid passage 72 is in fluid communication with sac 86 by way of purging fluid outlet 78. At the same time, fuel passage 52 is in fluid communication with sac 86. At this state, pressurized purging fluid can push fuel out of sac 86 and typically out of nozzle outlets 56, but also potentially back into fuel passage 52. At the same time that outlet check 74 returns to its closed position, or after outlet check 74 returns to its closed position, purging check 82 can be returned to its closed position, with fuel injector 30 now again in the configuration approximately as depicted in FIG. 4. The foregoing description can be analogously applied to the embodiment of FIG. 7, although it will be noted that sac 186 is not in fluid communication with nozzle outlets 156 when outlet check 174 is closed. Adjusting purging checks 82, 182 from a closed position can be commenced after commencing the returning of outlet checks 74, 174 from the open position to the closed position. Depending upon opening or closing timing of outlet checks 74, 174 and purging checks 82, 182, not just sac 86, 186 but also other parts of fuel passage 52, 152 could be purged, including at locations axially inward of outlet check seat 58, 158.

Figure 8:
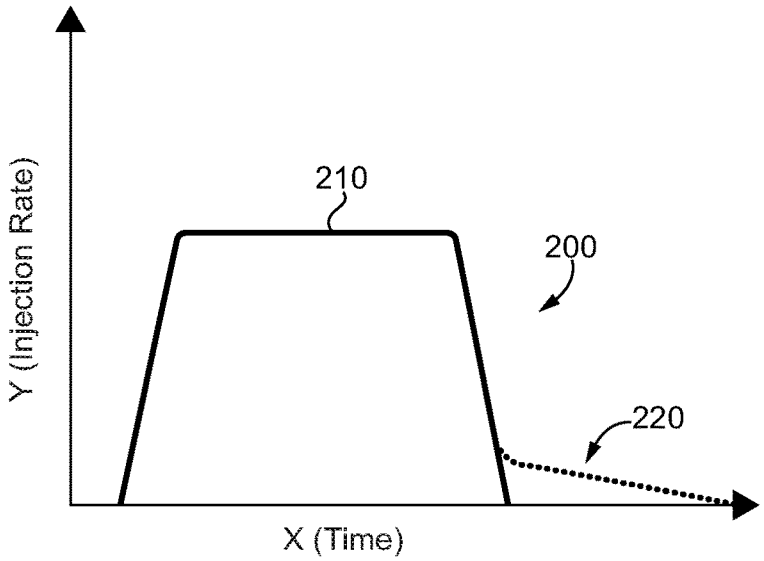
FIG. 8 is a graph illustrating injection rate shape over time.

Those skilled in the art will appreciate that sizing of hydraulic or pneumatic opening surfaces and/or closing surfaces, relative strength of electrical actuators, the timing of electrical actuator control signals and/or the strength of electrical actuator control signals, are all factors that could be varied to achieve a particular pattern of adjusting check assembly 70. It will generally be desirable to provide purging fluid at a pressure that is greater than fuel pressure. At minimum, purge pressure will typically be higher than cylinder pressure at end of injection. For these reasons, an internal pressurization mechanism within each fuel injector such as plunger 66 provides a practical implementation strategy. It will also be recalled that operating fuel system 22 in the manner discussed herein can reduce fuel dribble out of fuel injector 30, and other fuel injectors contemplated herein, by way of the purging of fuel passage 52, and in particular sac 86, of fuel. Referring now to FIG. 8, there is shown a graph 200 illustrating an example fuel injection rate shape in a curve 210. It can be seen in phantom lines that a fuel dribble knee 220 is shown following a main injection. The main injection shown via curve 210 has a generally square shape, apart from knee 220. Those skilled in the art will also appreciate that in a fuel injector operated and designed according to the present disclosure, knee 220 can be reduced or eliminated, as fuel that might otherwise dribble out of fuel injector 30 at reduced pressure and/or reduced atomization has been purged, resulting in improved emissions and fuel efficiency.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel injector comprising:

an injector body defining a longitudinal axis and including a nozzle, and having formed therein a fuel passage extending between a fuel inlet and a set of nozzle outlets;

the nozzle including an outlet check seat, and the set of nozzle outlets being distributed circumferentially about the longitudinal axis at locations that are adjacent to the outlet check seat and radially inward of the outlet check seat;

the nozzle further including a nozzle tip inner surface that is adjacent to the set of nozzle outlets and located radially inward of the set of nozzle outlets, and the nozzle tip inner surface having a continuous extent amongst the set of nozzle outlets, such that the nozzle tip inner surface defines a sac forming a blind end of the fuel passage;

a check assembly positioned within the injector body, the check assembly having formed therein a purging fluid passage extending between a purging fluid inlet and a purging fluid outlet that opens to the fuel passage;

the check assembly including an outlet check movable within the injector body between a retracted position where the fuel passage is in fluid communication with the set of nozzle outlets, and an advanced position where the outlet check contacts the outlet check seat; and the check assembly further including a purging check movable within the injector body between an advanced position where the purging check blocks the purging fluid outlet, and a retracted position where the purging fluid passage is in fluid communication with the fuel passage to admit purging fluid to the fuel passage for purging the sac of fuel.

2. The fuel injector of claim 1 wherein the outlet check and the purging check are coaxially arranged with one another within the injector body.

3. The fuel injector of claim 2 wherein the purging check is positioned within the outlet check, and the outlet check includes a distal tip having the purging fluid outlet formed therein.

4. The fuel injector of claim 3 wherein the purging fluid passage is formed between the outlet check and the purging check.

5. The fuel injector of claim 3 wherein the outlet check includes a purging check seat contacted by the purging check at the advanced position and extending circumferentially around the purging fluid outlet.

6. The fuel injector of claim 3 wherein the purging fluid outlet opens to the sac.

7. The fuel injector of claim 6 wherein the set of nozzle outlets are in fluid communication with the sac at the advanced position of the outlet check.

8. The fuel injector of claim 6 wherein the purging check seat is located radially inward of the outlet check seat.

9. A fuel system comprising:

a fuel supply;

a purging fluid supply;

a fuel injector having each of a fuel passage and a purging fluid passage formed therein, the fuel passage extending between a fuel inlet connected with the fuel supply and a set of nozzle outlets, and the purging fluid passage extending between a purging fluid inlet connected with the purging fluid supply and a purging fluid outlet that opens to the fuel passage;

the fuel injector further including a nozzle tip inner surface that is adjacent to the set of nozzle outlets and has a continuous extent amongst the set of nozzle outlets, such that the nozzle tip inner surface defines a sac forming a blind end of the fuel passage;

the fuel injector further including an outlet check movable to control opening and closing of the plurality of nozzle outlets, and a purging check; and the purging check being movable between an advanced position where the purging check blocks the purging fluid outlet, and a retracted position where the purging fluid passage is in fluid communication with the fuel passage to admit purging fluid to the fuel passage for purging the sac of fuel.

10. The fuel system of claim 9 wherein the outlet check and the purging fluid check are coaxially arranged with one another within the fuel injector, and the purging fluid passage is formed between the outlet check and the purging fluid check.

11. The fuel system of claim 10 wherein the purging fluid check is positioned within the outlet check.

12. The fuel system of claim 11 wherein the purging fluid outlet is formed within the outlet check.

13. The fuel system of claim 12 wherein the outlet check includes a purging check seat contacted by the purging check at the advanced position and extending circumferentially around the purging fluid outlet.

14. The fuel system of claim 13 wherein the fuel injector further includes an outlet check seat contacted by the outlet check at the advanced position, and wherein the purging check seat is located radially inward of the outlet check seat.

15. The fuel system of claim 14 wherein the purging fluid outlet opens to the sac.

16. A method of operating a fuel system for an internal combustion engine comprising:

adjusting an outlet check in a fuel injector from a closed position to an open position;

spraying fuel out of a set of nozzle outlets in response to the adjusting of the outlet check in the fuel injector from a closed position to an open position;

adjusting a purging check in the fuel injector from a closed position to an open position;

purging the fuel passage of fuel by way of purging fluid admitted to the fuel passage in response to the adjusting of the purging check in the fuel injector from the closed position to the open position; and reducing fuel dribble out of the fuel injector by way of the purging of the fuel passage of fuel.

17. The method of claim 16 wherein the purging of the fuel passage of fuel includes purging a sac within the fuel injector of fuel.

18. The method of claim 16 wherein the purging fluid includes pressurized air, and the purging of the sac includes pushing fuel from the sac out of the plurality of nozzle outlets by way of the pressurized air.

19. The method of claim 16 further comprising returning the outlet check to the closed position, and wherein the adjusting of the purging check in the fuel injector from a closed position to an open position is commenced prior to completing the returning of the outlet check from the open position to the closed position.

20. The method of claim 19 wherein the adjusting of the purging check from a closed position to an open position is commenced after commencing the returning of the outlet check from the open position to the closed position.

* * * * *